US006032925A

United States Patent [19]

Izuo et al.

[11] Patent Number: 6,032,925

[45] Date of Patent: Mar. 7, 2000

[54] GEL CUSHIONED SOLENOID VALVE DEVICE

[75] Inventors: Takashi Izuo, Toyota; Shoichiro Nitta, Nishikamo-gun; Tatsuo Iida, Toyota; Masahiko Asano, Toyota; Hiroyuki Hattori, Toyota, all of Japan

[73] Assignee: Toyota Jidosha Kabushiki Kaisha, Aichi, Japan

[21] Appl. No.: 09/119,193

[22] Filed: Jul. 20, 1998

[30] Foreign Application Priority Data

Aug. 8, 1997 [JP] Japan ..... 9-215012
Dec. 5, 1997 [JP] Japan ..... 9-335970

[51] Int. Cl.[7] ..... F16K 31/02

[52] U.S. Cl. ..... 251/129.17; 251/64; 251/129.19

[58] Field of Search ..... 251/64, 129.07, 251/129.19; 123/90.11

[56] References Cited

FOREIGN PATENT DOCUMENTS 393634 10/1990 European Pat. Off. .
19646937 5/1998 Germany .
60-175805 11/1985 Japan .
6-129219 5/1994 Japan .
2137420 10/1984 United Kingdom .

OTHER PUBLICATIONS

Patent Abstracts of Japan, vol. 95, No. 6, Jul. 31, 1995 & JP 07 071500 A (Kehin Seiki Mfg. Co, Ltd.), Mar. 17, 1995.

*Primary Examiner*—Joseph A. Kaufman
*Assistant Examiner*—David A. Bonderer
*Attorney, Agent, or Firm*—Kenyon & Kenyon

[57] ABSTRACT

In a solenoid valve device, a valving element opens and closes a fluid passage by exerting an electromagnetic force between an armature and a core. The solenoid valve device includes a movable portion which includes the armature and the valving element. A fixed portion includes the core. An impact absorbing unit absorbs an impact of the movable portion on the fixed portion, the impact absorbing unit including a gel part which transforms a mechanical energy of the impact into a thermal energy.

10 Claims, 11 Drawing Sheets

GEL CUSHIONED SOLENOID VALVE DEVICE

BACKGROUND OF THE INVENTION (1) Field of the Invention

The present invention relates to a solenoid valve device which functions as one of intake valves and exhaust valves of an internal combustion engine.

(2) Description of the Related Art

As disclosed in Japanese Laid-Open Utility Model Application No.60-175805 and Japanese Laid-Open Patent Application No.6-129219, there is known a solenoid valve device which functions as one of intake valves and exhaust valves of an internal combustion engine. Such a solenoid valve device is provided with a valving element which opens and closes a fluid passage between a port and a combustion chamber of the engine by exerting an electromagnetic force between an armature and a core.

In the conventional solenoid valve device of the above publications, the armature is integrally formed with the valving element, and the armature and the valving element are supported so as to be movable in an axial direction of the device. A coil contained in the core is provided above the armature. As an exciting current is supplied to the coil, the electromagnetic force is exerted between the armature and the core. The valving element moves up and down in the axial direction in accordance with the movement of the armature relative to the core. Hence, in the conventional solenoid valve device, the valving element is actuated to open or close the fluid passage by supplying the exciting current to the coil or cutting the exciting current supplied to the coil.

The valving element moves to a valve-closed position and abuts on a valve seat at which the fluid passage is fully closed. At this time, the armature impacts on the core and an impact sound is produced. The higher the speed of movement of the armature when the valving element reaches the valve-closed position, the louder the impact sound due to the impact between the armature and the core.

In order to reduce the impact sound of the conventional solenoid valve device, it is desirable to reduce the speed of movement of the armature before the valving element reaches the valve-closed position. The conventional solenoid valve device of the above publications includes an impact absorbing spring provided at the top of the valving element opposite to the valve seat. The impact absorbing spring functions to reduce the speed of movement of the armature before the valving element reaches the valve-closed position. The impact absorbing spring exerts an actuating force on the armature and the valving element in a direction to push the valving element toward a valve-open position when the valving element is moving to the valve-closed position. By using the impact absorbing spring, the speed of movement of the armature before the valving element reaches the valve-closed position is reduced, and it is possible for the conventional solenoid valve device to reduce the impact sound.

However, in the conventional solenoid valve device of the above publications, the actuating force of the impact absorbing spring functions to push the valving element toward the valve-open position (or in the direction opposite to the valve-closed position) not only when the valving element moves to the valve-closed position but also when the valving element is held at the valve-closed position. It is required for the conventional solenoid valve device to supply a large amount of the exciting current to the coil when the valving element is held at the valve-closed position against the actuating force of the impact absorbing spring. The electromagnetic force which is greater than the actuating force of the impact absorbing spring must be produced by supplying the large amount of the exciting current in order to hold the valving element at the valve-closed position. Hence, it is difficult for the conventional solenoid valve device of the above publications to effectively decrease power consumption.

SUMMARY OF THE INVENTION

An object of the present invention is to provide an improved solenoid valve device in which the above-described problems are eliminated.

Another object of the present invention is to provide a solenoid valve device which effectively decreases the power consumption as well as effectively reduces the impact sound.

The above-mentioned object of the present invention is achieved by a solenoid valve device in which a valving element opens and closes a fluid passage by exerting an electromagnetic force between an armature and a core, the solenoid valve device comprising: a movable portion which includes the armature and the valving element; a fixed portion which includes the core; and an impact absorbing unit which absorbs an impact of the movable portion on the fixed portion, the impact absorbing unit having a gel part transforming a mechanical energy of the impact into a thermal energy.

The above-mentioned objects of the present invention are achieved by a solenoid valve device in which a valving element opens and closes a fluid passage by exerting an electromagnetic force between an armature and a core, the solenoid valve device comprising: a movable portion which includes the armature and the valving element; a fixed portion which includes the core and a case, wherein the core is movably held by the case such that the core is movable in an axial direction of the solenoid valve device; and an impact absorbing unit which absorbs an impact of the movable portion on the fixed portion, the impact absorbing unit including a gel part provided between the core and the case, the gel part transforming a mechanical energy of the impact into a thermal energy.

The above-mentioned objects of the present invention are achieved by a solenoid valve device in which a valving element opens and closes a fluid passage by exerting an electromagnetic force between an armature and a core, the solenoid valve device comprising: a movable portion which includes the armature and the valving element; a fixed portion which includes the core; and an impact absorbing unit which is provided at a position where the movable portion hits the fixed portion, the impact absorbing unit absorbing an impact of the movable portion on the fixed portion, the impact absorbing unit including a foam part, the foam part being deformed and compressed when absorbing the impact.

In the solenoid valve device of the present invention, when the valving element moves to the valve-closed position and abuts on the valve seat at which the fluid passage is fully closed, the movable portion impacts on the fixed portion and an impact sound is produced. The gel part is deformed and transforms part of the impact energy of the movable portion on the fixed portion into a thermal energy. In the gel part, the thermal energy is dispersed and the remaining impact energy is absorbed due to the deformation of the gel part. It is not necessary to supply a large amount of an exciting current to the solenoid coil in order to maintain the valving element at the valve-closed position against the actuating force of the impact absorbing spring as in the conventional solenoid valve device. Hence, the solenoid valve device of the present invention is not only effective in reducing the impact sound but also effective in decreasing the power consumption.

BRIEF DESCRIPTION OF THE DRAWINGS

The above and other objects, features and advantages of the present invention will become more apparent from the following detailed description when read in conjunction with the accompanying drawings in which.

DESCRIPTION OF THE PREFERRED EMBODIMENTS

A description will now be given of the preferred embodiments of the present invention with reference to the accompanying drawings.

Figure 1:
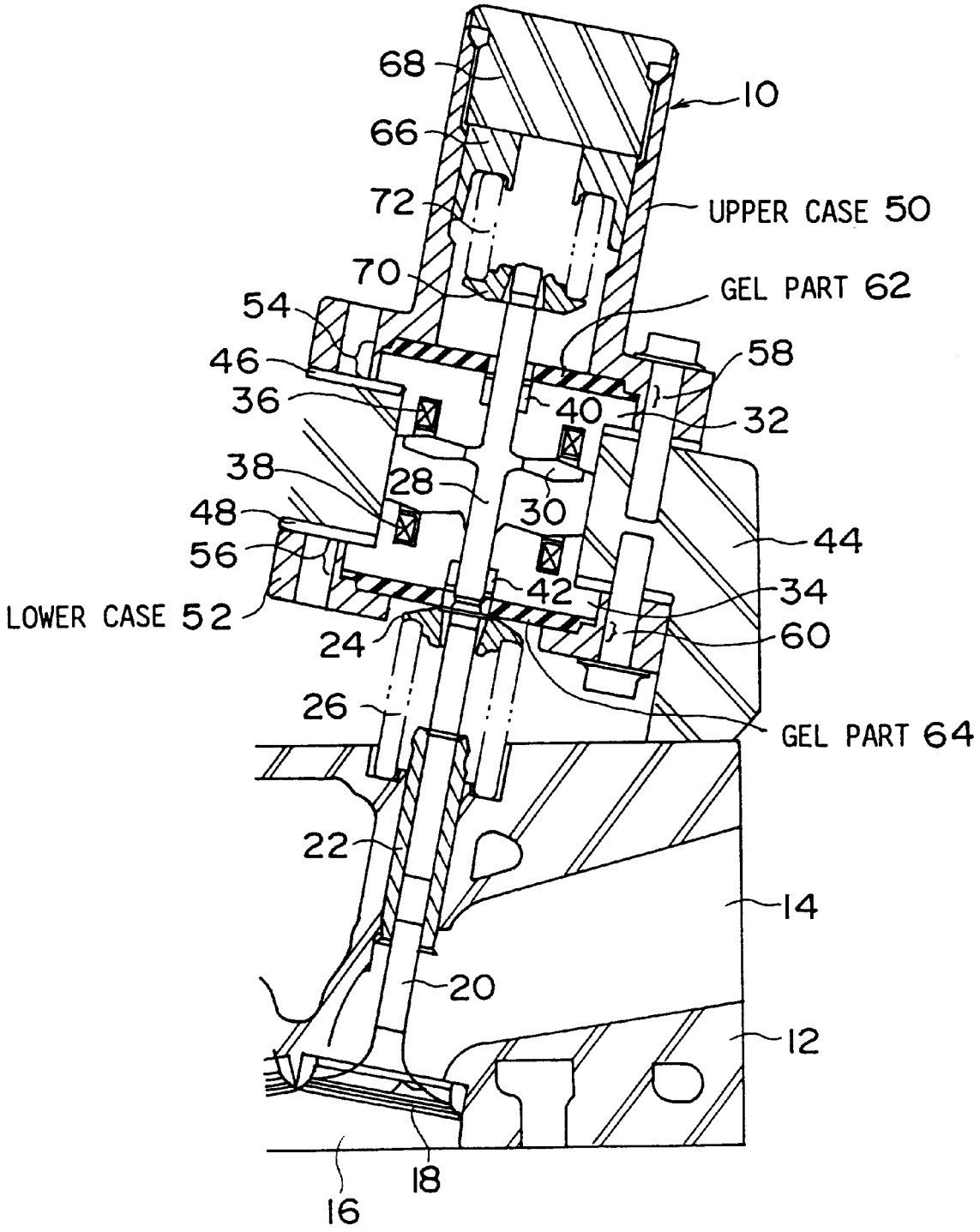
FIG. 1 is a cross-sectional view of a first embodiment of a solenoid valve device which incorporates the principles of the present invention.

FIG. 1 shows a first embodiment of a solenoid valve device which incorporates the principles of the present invention.

As shown in FIG. 1, a solenoid valve device of the present embodiment functions as one of intake valves and exhaust valves of an internal combustion engine. The solenoid valve device 10 is provided in a cylinder head 12 of the engine. The cylinder head 12 is provided with a port 14 and a combustion chamber 16. The solenoid valve device 10 includes a valving element 18 which opens and closes a fluid passage between the port 14 and the combustion chamber 16.

A valve shaft 20 is integrally formed with the valving element 18. A valve guide 22 is provided in the cylinder head 12, and in the valve guide 22 the valve shaft 20 is movably held such that the valve shaft 20 is movable in an axial direction of the solenoid valve device 10. A lower retainer 24 is fixed to the top of the valve shaft 20. A lower spring 26 is provided below the lower retainer 24. The lower spring 26 exerts an actuating force on the lower retainer 24 so as to push the lower retainer 24 in the upward direction of FIG. 1.

The upper end of the valve shaft 20 is brought into contact with an armature shaft 28. The armature shaft 28 is formed from a non-magnetic material. An armature 30 is integrally formed with the armature shaft 28. The armature 30 is an annular member which is formed from a magnetic material.

An upper core 32 is provided above the armature 30, and a lower core 34 is provided below the armature 30. The upper core 32 and the lower core 34 are annular members which are formed from a magnetic material. An upper coil 36 is contained in the upper core 32, and a lower coil 38 is contained in the lower core 34. A bearing 40 is provided in the middle of the upper core 32, and a bearing 42 is provided in the middle of the lower core 34. The armature shaft 28 is slidably supported by the bearings 40 and 42.

A core guide 44 is provided on the outer periphery of the upper core 32 and the lower core 34. The upper core 32 and the lower core 34 are separated from each other at an appropriate distance. The relative position between the upper core 32 and the lower core 34 is maintained at the appropriate distance by the core guide 44. An upper case 50 is bolted through a spacer 46 to the top of the core guide 44, and a lower case 52 is bolted through a spacer 48 to the bottom of the core guide 44.

A core mounting portion 54 is provided in the upper case 50, and a core mounting portion 56 is provided in the lower case 52. The core mounting portion 54 has a depth that is slightly greater than a thickness of a flanged portion of the upper core 32. The core mounting portion 56 has a depth that is slightly greater than a thickness of a flanged portion of the lower core 34. Hence, the upper core 32 is slightly movable within the core mounting portion 54 in the axial direction of the device 10, and the lower core 34 is slightly movable within the core mounting portion 56 in the axial direction of the device 10.

Hence, in the solenoid valve device 10 of the present embodiment, there are provided a movable portion including the armature 30 and the valving element 18, and a fixed portion including the upper core 32 and the lower core 34. In the solenoid valve device 10, the valving element 18 opens and closes the fluid passage between the port 14 and the combustion chamber 16 by exerting either an electromagnetic force between the armature 30 and the upper core 32 or an electromagnetic force between the armature 30 and the lower core 34. The solenoid valve device 10 further includes an impact absorbing unit which absorbs an impact of the movable portion on the fixed portion, and a description of the impact absorbing unit in the solenoid valve device 10 will be given below.

A gel mounting portion 58 is provided in the upper case 50, and a gel mounting portion 60 is provided in the lower case 52. A gel part 62 is provided in the gel mounting portion 58, and a gel part 64 is provided in the gel mounting portion 60. Each of the gel part 62 and the gel part 64 is provided in the form of a round plate having a through hole in the center of the round plate. The armature shaft 28 passes through the through holes of both the gel part 62 and the gel part 64. In the solenoid valve device 10 of the present embodiment, the impact absorbing unit includes the gel part 62 and the gel part 64, and a description thereof will be given below.

The gel parts 62 and 64 are component parts of a gel-state substance in which colloidal particles, which are prepared from one of silicones, styrenes, urethanes and other resins, are formed in a jelly-like solid state. The gel parts 62 and 64 have a large compression vs deflection coefficient and a small viscosity coefficient. When the gel parts 62 and 64 are subjected to compression impact between the armature 30 and the cores 32 and 34, the gel parts 62 and 64 are deformed and transform part of a mechanical energy of the impact into a thermal energy. In the gel parts 62 and 64, the thermal energy is dispersed and the remaining impact energy is absorbed due to the deformation of the gel parts 62 and 64.

A spring guide 66 and an adjusting bolt 68 are provided in an upper portion of the upper case 50. An upper retainer 70 is provided below the spring guide 66. The upper retainer 70 is fixed to the top of the armature shaft 28. An upper spring 72 is provided between the spring guide 66 and the upper retainer 70. The upper spring 72 exerts an actuating force on the armature shaft 28 and the upper retainer 70 so as to push the armature shaft 28 and the upper retainer 70 in the downward direction of FIG. 1. A neutral position of the armature 30 at which the armature 30 is kept in a state of equilibrium with the actuating force of the lower spring 26 and the actuating force of the upper spring 72 canceling each other is adjusted by fastening or loosening the adjusting bolt 68. In the present embodiment, the adjustment is performed using the adjusting bolt 68 such that the neutral position of the armature 30 is set at a central position between the upper core 32 and the lower core 34.

Next, a description will be given of an operation of the solenoid valve device 10 with reference to FIG. 1.

When no exciting current is supplied to the upper coil 36 and the lower coil 38, the armature 30 is held at the neutral position which is the central position between the upper core 32 and the lower core 34 in the present embodiment. When a proper exciting current is supplied to the upper coil 36 with the armature 30 being held at the neutral position, an electromagnetic force is exerted between the armature 30 and the upper core 32 such that the armature 30 is attracted toward the upper core 32 by the electromagnetic force. Hence, in the solenoid valve device 10, when the exciting current is supplied to the upper coil 36, the armature 30 moves up to the upper core 32 together with the armature shaft 28 and the valve shaft 20, and the valving element 18 moves up in accordance with the movement of the armature 30 so as to close the fluid passage between the port 14 and the combustion chamber 16.

Hereinafter, a position of the valving element 18 at which the valving element 18 fully closes the fluid passage will be called a valve-closed position. Similarly, a position of the valving element 18 at which the valving element 18 fully opens the fluid passage will be called a valve-open position.

In the solenoid valve device 10 of the present embodiment, the following phenomena sequentially occur during the movement of the valving element 18 to the valve-closed position:

(1) The valving element 18 moves up together with the valve shaft 20 and the armature shaft 28.

(2) The lower retainer 24 on the valve shaft 20 hits the gel part 64.

(3) The valving element 18 moves up to the valve-closed position with the gel part 64 being deformed by the lower retainer 24, and the armature shaft 28 is separated from the valve shaft 20 and further moves up until the armature 30 contacts the upper core 32.

In the solenoid valve device 10 of the present embodiment, when a proper exciting current is supplied to the upper coil 36, the valving element 18 can move up to the valve-closed position in the above-described manner.

According to the solenoid valve device 10, when the gel part 64 is deformed after the lower retainer 24 hits the gel part 64, the mechanical energy of the impact is effectively absorbed due to the deformation of the gel part 64. The speed of the upward movement of the valving element 18 is rapidly decreased with the absorption of the impact energy, and it is possible for the solenoid valve device 10 of the present embodiment to effectively reduce the impact sound when the valving element 18 reaches the valve-closed position.

When the gel part 64 is deformed after the lower retainer 24 hits the gel part 64, the gel part 64 transforms part of the mechanical energy of the impact into a thermal energy. In the gel part 64, the thermal energy is dispersed and the remaining impact energy is absorbed due to the deformation of the gel part 64. The mechanical energy given to the gel part 64 by the lower retainer 24 is effectively reduced due to the dispersion of the thermal energy in the gel part 64. Hence, it is not necessary to provide the lower spring 26 with a large spring constant because of the gel part 64, and the lower spring 26 which provides a relatively small actuating force can be used for the solenoid valve device 10 of the present embodiment. The solenoid valve device 10 of the present embodiment is effective in stably maintaining the valving element 18 at the valve-closed position.

In the solenoid valve device 10, when the armature 30 reaches the upper core 32, an impact energy is given to the upper core 32 by the armature 30. As described above, the upper core 32 is slightly movable within the core mounting portion 54 in the axial direction of the device 10. The gel part 62 is deformed at that time by the upward movement of the armature 30. Hence, the impact energy produced when the armature 30 hits the upper core 32 is effectively absorbed due to the deformation of the gel part 62. The speed of the upward movement of the armature 30 is rapidly decreased with the absorption of the impact energy, and it is possible for the solenoid valve device 10 of the present embodiment to effectively reduce the impact sound when the armature 30 reaches the upper core 32.

After the armature 30 contacts the upper core 32, only the actuating force of the upper spring 72 acts to push the armature 30 in the downward direction to separate the armature 30 from the upper core 32. The gel parts 62 and 64 function to absorb the impact energy of the armature 30 on the upper core 32. It is not necessary to supply a large amount of the exciting current to the upper coil 36 in order to maintain the valving element 18 at the valve-closed position against the actuating force of the impact absorbing spring as in the conventional solenoid valve device.

If an electromagnetic force that is greater than the actuating force of the upper spring 72 is exerted between the armature 30 and the upper core 32 when the armature 30 is in contact with the upper core 32, it is possible for the solenoid valve device 10 of the present embodiment to maintain the valving element 18 at the valve-closed position. In the solenoid valve device 10 of the present embodiment, the upper spring 72 which provides a relatively small actuating force can be used because of the gel part 62. Hence, the solenoid valve device 10 of the present invention is not only effective in reducing the impact sound but also effective in decreasing the power consumption.

When the exciting current supplied to the upper coil 36 is cut with the valving element 18 being held at the valve-closed position, the armature 30 starts moving in the downward direction of FIG. 1, together with the armature shaft 28 and the valve shaft 20, due to the actuating force of the upper spring 72. In the solenoid valve device 10 of the present embodiment, the supplying of the exciting current to the lower coil 38 is started at an appropriate timing. An electromagnetic force to push the armature 30 in the downward direction of FIG. 1 is exerted between the armature and the lower core 34, and the movement of the armature 30 can be continued until the armature 30 contacts the lower core 34.

In the solenoid valve device 10 of the present embodiment, the following phenomena sequentially occur during the movement of the valving element 18 to the valve-open position:

(1) The valving element 18 moves down together with the valve shaft 20 and the armature shaft 28.

(2) The upper retainer 70 on the armature shaft 28 hits the gel part 62.

(3) The valving element 18 moves down to the valve-open position with the gel part 62 being deformed by the upper retainer 70. The armature shaft 28 contacts the valve shaft 20 and the armature 30 further moves down until the armature 30 hits the lower core 34.

In the solenoid valve device 10 of the present embodiment, when a proper exciting current is supplied to the lower coil 38, the valving element 18 can move down to the valve-open position in the above-described manner.

According to the solenoid valve device 10, when the gel part 62 is deformed after the upper retainer 70 hits the gel part 62, the mechanical energy of the impact is effectively absorbed due to the deformation of the gel part 62. The speed of the downward movement of the valving element 18 is rapidly decreased with the absorption of the impact energy, and it is possible for the solenoid valve device 10 of the present embodiment to effectively reduce the impact sound when the valving element 18 reaches the valve-open position.

When the gel part 62 is deformed after the upper retainer 70 hits the gel part 62, the gel part 62 transforms part of the mechanical energy of the impact into a thermal energy. In the gel part 62, the thermal energy is dispersed and the remaining impact energy is absorbed due to the deformation of the gel part 62. The mechanical energy given to the gel part 62 by the upper retainer 70 is effectively reduced due to the dispersion of the thermal energy in the gel part 62. Hence, it is not necessary to provide the upper spring 72 with a large spring constant because of the gel part 62, and the upper spring 72 which provides a relatively small actuating force can be used for the solenoid valve device 10 of the present embodiment. The solenoid valve device 10 of the present embodiment is effective in stably maintaining the valving element 18 at the valve-open position.

In the solenoid valve device 10, when the armature 30 reaches the lower core 34, an impact energy is given to the lower core 34 by the armature 30. As described above, the lower core 34 is slightly movable within the core mounting portion 56 in the axial direction of the device 10. The gel part 64 is deformed at that time by the downward movement of the armature 30. Hence, the impact energy produced when the armature 30 hits the lower core 34 is effectively absorbed due to the deformation of the gel part 64. The speed of the downward movement of the armature 30 is rapidly decreased with the absorption of the impact energy, and it is possible for the solenoid valve device 10 of the present embodiment to effectively reduce the impact sound when the armature 30 reaches the lower core 34.

After the armature 30 contacts the lower core 34, the actuating force of the lower spring 26 acts to push the armature 30 in the upward direction to separate the armature 30 from the lower core 34. The gel parts 62 and 64 function to absorb the impact energy of the armature 30 on the lower core 34. It is not necessary to supply a large amount of the exciting current to the lower coil 38 in order to maintain the valving element 18 at the valve-open position.

If an electromagnetic force that is greater than the actuating force of the lower spring 26 is exerted between the armature 30 and the lower core 34 when the armature 30 is in contact with the lower core 34, it is possible for the solenoid valve device 10 of the present embodiment to maintain the valving element 18 at the valve-open position. In the solenoid valve device 10 of the present embodiment, the lower spring 26 which provides a relatively small actuating force can be used because of the gel part 64. Hence, the solenoid valve device 10 of the present invention is not only effective in reducing the impact sound but also effective in decreasing the power consumption.

In the above-described embodiment, when the valving element 18 moves to the valve-closed position, the gel parts 62 and 64 transform part of the mechanical energy of the impact of the armature 30 on one of the upper and lower cores 32 and 34 into the thermal energy. The gel parts 62 and 64 transform part of the mechanical energy of the impact of the retainers 70 and 24 on the gel parts 62 and 64 into the thermal energy. In the gel parts 62 and 64, the thermal energy is dispersed and the remaining impact energy is absorbed due to the deformation of the gel parts 62 and 64. It is not necessary to supply a large amount of the exciting current to the upper coil 36 in order to maintain the valving element at the valve-closed position against the actuating force of the impact absorbing spring as in the conventional solenoid valve device. It is not necessary to supply a large amount of the exciting current to the lower coil 38 in order to maintain the valving element at the valve-open position. Hence, the solenoid valve device 10 of the present embodiment is not only effective in reducing the impact sound but also effective in decreasing the power consumption.

Next, a description will be given of an example of a gel part suitable for the solenoid valve device according to the present invention.

Figure 2:
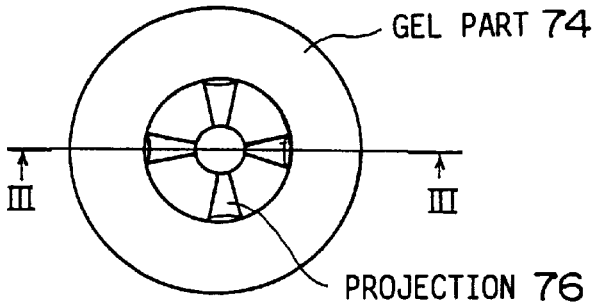
FIG. 2 is a top view of an example of a gel part suitable for the solenoid valve device according to the present invention.
Figure 3:
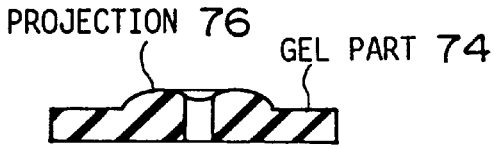
FIG. 3 is a cross-sectional view of the gel part taken along a line III—III indicated in FIG. 2.

FIG. 2 is a top view of a gel part 74. FIG. 3 is a cross-sectional view of the gel part 74 taken along a line III—III indicated in FIG. 2. The gel part 74 shown in FIG. 2 and FIG. 3 is an example that is suitable for the gel parts 62 and 64 in the solenoid valve device 10.

As shown in FIG. 2, the gel part 74 is provided in the form of a round plate having a through hole in the center of the round plate. The gel part 74 has one surface on which a plurality of projections 76 extending radially from the center of the gel part 74 are provided. The gel part 74 is installed in the solenoid valve device 10 such that the surface of the gel part 74 having the projections 76 confronts the upper retainer 70 or the lower retainer 24.

According to the gel part 74, when one of the upper retainer 70 and the lower retainer 24 hits the gel part 74, the projections 76 on the gel part 74 are easily and effectively deformed. The mechanical energy of the impact is effectively absorbed due to the deformation of the gel part 74.

The impact energy is largely transformed into a thermal energy because of the projections 76. It is possible for the solenoid valve device 10 having the gel part 74 to effectively reduce the impact sound and effectively decrease the power consumption.

Figure 4:
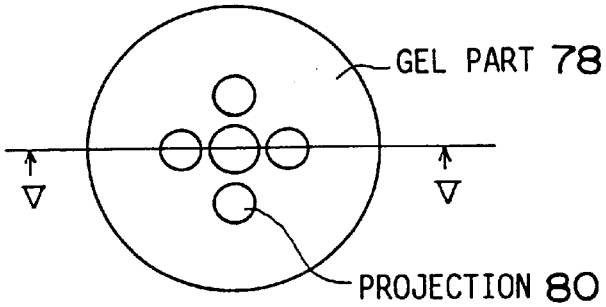
FIG. 4 is a top view of another example of the gel part suitable for the solenoid valve device according to the present invention.

FIG. 4 shows another example of the gel part suitable for the solenoid valve device according to the present invention.

Figure 5:
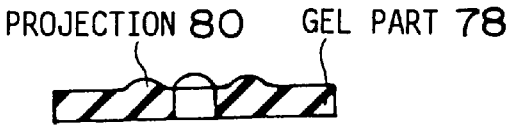
FIG. 5 is a cross-sectional view of the gel part taken along a line V—V indicated in FIG. 4.

FIG. 4 is a top view of a gel part 78. FIG. 5 is a cross-sectional view of the gel part 78 taken along a line V—V indicated in FIG. 4. The gel part 78 shown in FIG. 4 and FIG. 5 is another example that is suitable for the gel parts 62 and 64 in the solenoid valve device 10.

As shown in FIG. 4, the gel part 78 is provided in the form of a round plate having a through hole in the center of the round plate. The gel part 78 has one surface on which a plurality of projections 80 arrayed circumferentially around the center of the gel part 78 are provided. The gel part 78 is installed in the solenoid valve device 10 such that the surface of the gel part 78 having the projections 80 confronts the upper retainer 70 or the lower retainer 24.

Similar to the gel part 74, according to the gel part 78, when one of the upper retainer 70 and the lower retainer 24 hits the gel part 78, the projections 80 on the gel part 78 are easily and effectively deformed. The mechanical energy of the impact is effectively absorbed due to the deformation of the gel part 78. The impact energy is largely transformed into a thermal energy because of the projections 80. It is possible for the solenoid valve device 10 having the gel part 78 to effectively reduce the impact sound and effectively decrease the power consumption.

Figure 6:
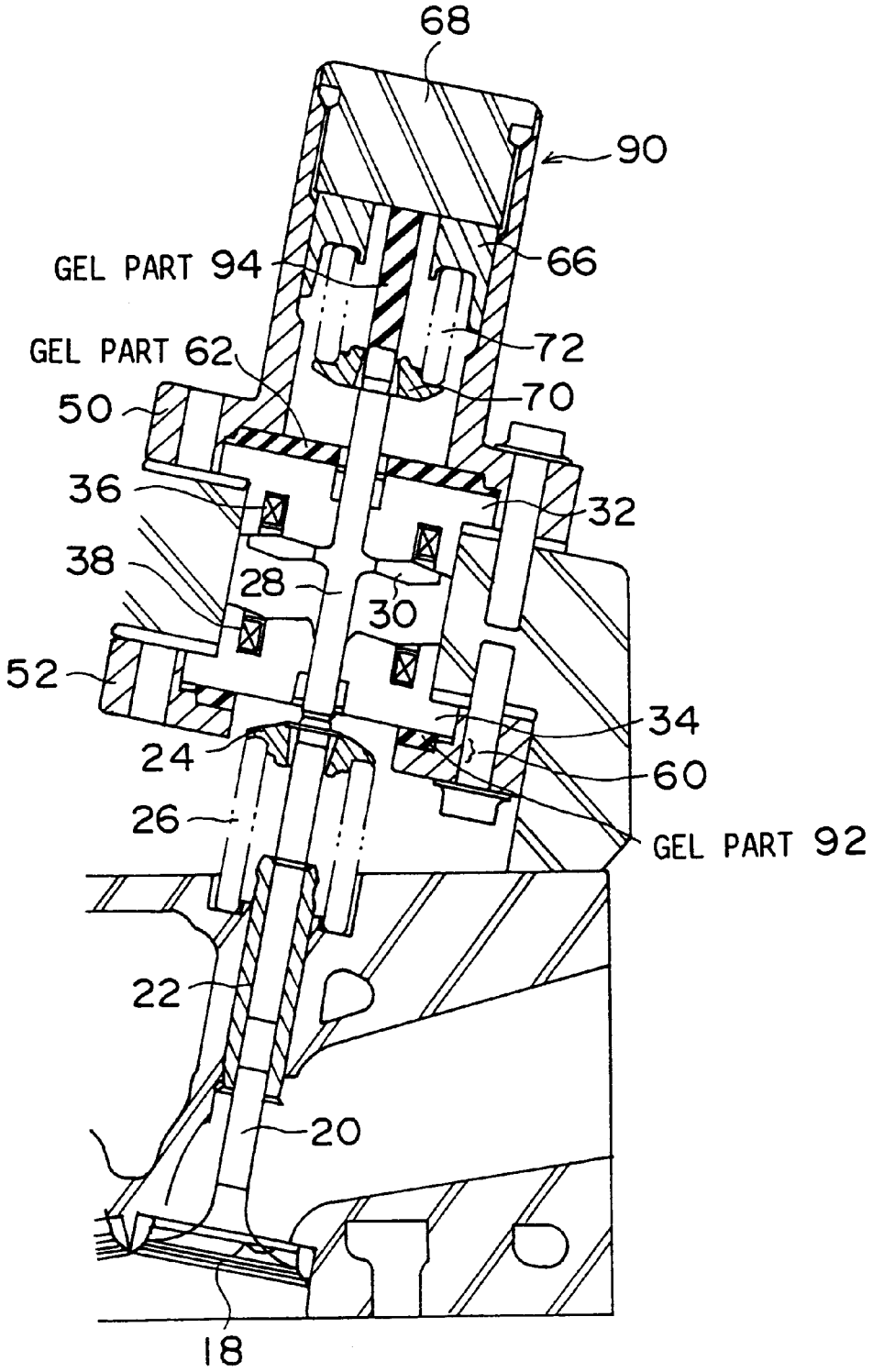
FIG. 6 is a cross-sectional view of a second embodiment of the solenoid valve device according to the present invention.

Next, FIG. 6 shows a second embodiment of the solenoid valve device which incorporates the principles of the present invention. In FIG. 6, the elements which are the same as corresponding elements in FIG. 1 are designated by the same reference numerals, and a description thereof will be omitted.

As shown in FIG. 6, a solenoid valve device 90 of the present embodiment includes the gel part 62 which is the same as that of the solenoid valve device 10 of FIG. 1. The solenoid valve device 90 includes a gel part 92 instead of the gel part 64 in the solenoid valve device 10 of FIG. 1. The solenoid valve device 90 has a gel part 94 in addition to the gel parts 62 and 92.

The gel part 92 is provided in the gel mounting portion 60 of the lower case 52. The gel part 92 is provided in the form of an annular plate having a through hole in the center of the plate. Hence, in the present embodiment, the lower retainer 24 does not contact the gel part 92. The gel part 92 is shaped so as to match with the shape of the gel mounting portion 60. The armature shaft 28 passes through the through holes of both the gel part 62 and the gel part 92. The gel part 94 is provided above the top of the armature shaft 28 (and below the adjusting bolt 68) such that the top of the armature shaft 28 contacts the gel part 94 when the valving element 18 nearly reaches the valve-closed position.

Similar to the solenoid valve device 10 of FIG. 1, in the solenoid valve device 90, when a proper exciting current is supplied to the upper coil 36, an electromagnetic force is exerted between the armature 30 and the upper core 32, and the valving element 18 can move up to the valve-closed position.

In the solenoid valve device 90 of the present embodiment, the following phenomena sequentially occur during the movement of the valving element 18 to the valve-closed position:

(1) The valving element 18 moves up together with the valve shaft 20 and the armature shaft 28.

(2) The armature shaft 28 hits the gel part 94.

(3) The valving element 18 further moves up with the gel part 94 being deformed by the armature shaft 28.

(4) The valving element 18 moves up to the valve-closed position. The armature shaft 28 is separated from the valve shaft 20 after the valving element 18 reaches the valve-closed position, and the armature shaft 28 further moves up with the gel part 94 being deformed until the armature 30 contacts the upper core 32.

In the solenoid valve device 90 of the present embodiment, when a proper exciting current is supplied to the upper coil 36, the valving element 18 can move up to the valve-closed position in the above-described manner.

According to the solenoid valve device 90, when the gel part 94 is deformed by the armature shaft 28, the mechanical energy of the impact is effectively absorbed due to the deformation of the gel part 94. The speed of the upward movement of the valving element 18 is rapidly decreased with the absorption of the impact energy, and it is possible for the solenoid valve device 90 of the present embodiment to effectively reduce the impact sound when the valving element 18 reaches the valve-closed position.

In the solenoid valve device 90 of the present embodiment, the armature shaft 28 is separated from the valve shaft 20 after the valving element 18 reaches the valve-closed position, and the armature shaft 28 further moves up with the gel part 94 being deformed until the armature 30 contacts the upper core 32. After the armature 30 contacts the upper core 32, the impact energy is given to the upper core 32 by the armature 30. This impact energy is effectively absorbed due to the deformation of the gel part 94 as well as the deformation of the gel part 62. Hence, it is possible for the solenoid valve device 90 of the present embodiment to more effectively reduce the impact sound after the armature 30 contacts the upper core 32.

After the armature 30 contacts the upper core 32, only the actuating force of the upper spring 72 acts to push the armature 30 in the downward direction to separate the armature 30 from the upper core 32. The gel parts 62 and 94 function to absorb the impact energy of the armature 30 on the upper core 32 when the armature 30 is in contact with the upper core 32. It is not necessary to supply a large amount of the exciting current to the upper coil 36 in order to maintain the valving element 18 at the valve-closed position against the actuating force of the impact absorbing spring as in the conventional solenoid valve device.

If an electromagnetic force that is greater than the actuating force of the upper spring 72 is exerted between the armature 30 and the upper core 32 when the armature 30 is in contact with the upper core 32, it is possible for the solenoid valve device 90 of the present embodiment to maintain the valving element 18 at the valve-closed position. In the solenoid valve device 90 of the present embodiment, the upper spring 72 which provides a relatively small actuating force can be used because of the gel parts 62 and 94. Hence, the solenoid valve device 90 of the present invention is not only effective in reducing the impact sound but also effective in decreasing the power consumption.

In the solenoid valve device 90 of the present embodiment, when the exciting current supplied to the upper coil 36 is cut and the supplying of the exciting current to the lower coil 38 is started at an appropriate timing, an electromagnetic force to push the armature 30 in the downward direction of FIG. 6 is exerted between the armature 30 and the lower core 34, and the valving element 18 can move down to the valve-open position. During the downward movement of the valving element 18 to the valve-open position, the gel parts 62 and 92 function to absorb the impact energy of the upper retainer 70 and the gel part 62 and the impact energy of the armature 30 and the lower core 34 in the same manner as the gel parts 62 and 64 in the solenoid valve device 10 of FIG. 1. Hence, when the valving element 18 moves to the valve-open position and the valving element 18 is held at the valve-open position, the solenoid valve device 90 of the present embodiment is not only effective in reducing the impact sound but also effective in decreasing the power consumption.

Accordingly, in the solenoid valve device 90 of the present embodiment, when the valving element 18 opens and closes the fluid passage, it is possible to effectively reduce the impact sound and effectively decrease the power consumption.

Figure 7:
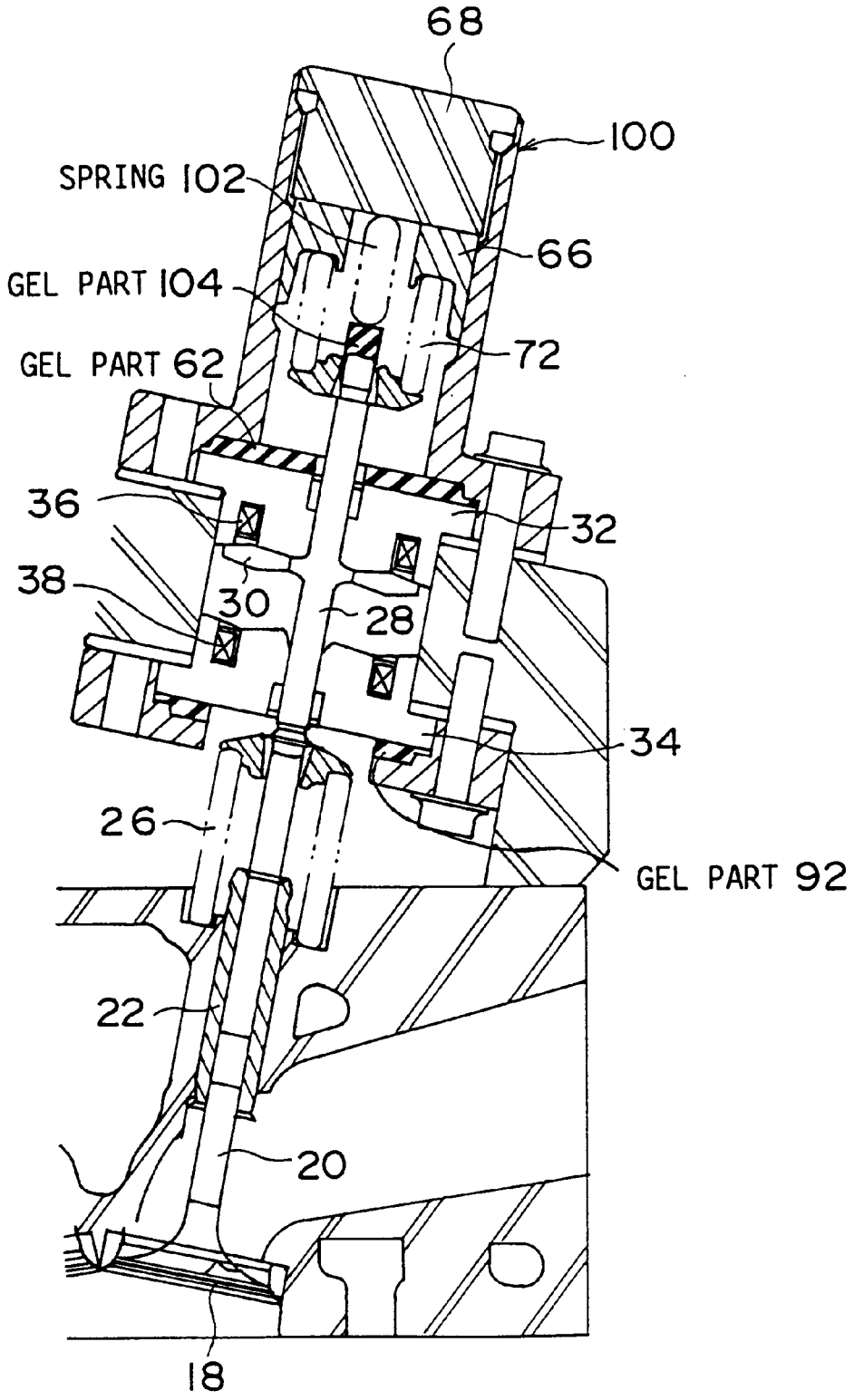
FIG. 7 is a cross-sectional view of a third embodiment of the solenoid valve device according to the present invention.

Next, FIG. 7 shows a third embodiment of the solenoid valve device which incorporates the principles of the present invention. In FIG. 7, the elements which are the same as corresponding elements in FIG. 1 are designated by the same reference numerals, and a description thereof will be omitted.

As shown in FIG. 7, a solenoid valve device 100 of the present embodiment includes the gel part 62 which is the same as that of the solenoid valve device 10 of FIG. 1. The solenoid valve device 100 includes the gel part 92 instead of the gel part 64 in the solenoid valve device 10 of FIG. 1. The solenoid valve device 100 includes a spring 102 and a gel part 104 in addition to the gel parts 62 and 92.

The gel part 92 in the solenoid valve device 100 of FIG. 7 is the same as the gel part 92 in the solenoid valve device 90 of FIG. 6, and a description thereof will be omitted. The spring 102 is provided below the adjusting bolt 68, and the gel part 104 is provided between the spring 102 and the top of the armature shaft 28. The top of the armature shaft 28 contacts the gel part 104 when the valving element 18 nearly reaches the valve-closed position.

The solenoid valve device 100 of the present embodiment has the same configuration as the embodiment of FIG. 6 except that the solenoid valve device 100 includes the spring 102 and the gel part 104. In the solenoid valve device 100 of the present embodiment, the spring 102 and the gel part 104 function in the same manner as the gel part 94 in the embodiment of FIG. 6.

Accordingly, in the solenoid valve device 100 of the present embodiment, when the valving element 18 opens and closes the fluid passage, it is possible to effectively reduce the impact sound and effectively decrease the power consumption.

Figure 8:
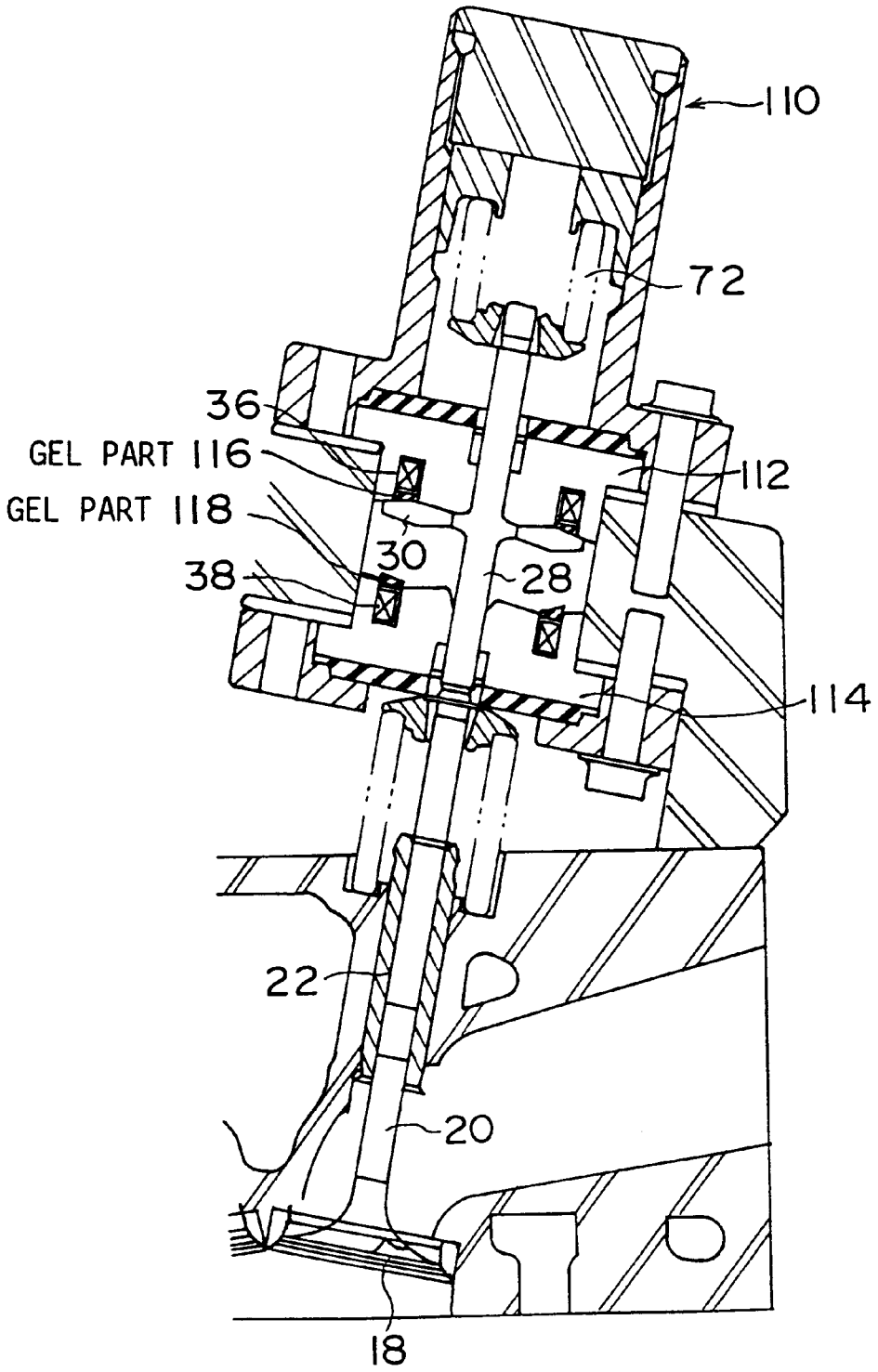
FIG. 8 is a cross-sectional view of a fourth embodiment of the solenoid valve device according to the present invention.

Next, FIG. 8 shows a fourth embodiment of the solenoid valve device which incorporates the principles of the present invention. In FIG. 8, the elements which are the same as corresponding elements in FIG. 1 are designated by the same reference numerals, and a description thereof will be omitted.

As shown in FIG. 8, a solenoid valve device 110 of the present embodiment includes an upper core 112 and a lower core 114. The upper core 112 includes the upper coil 36 contained in the upper core 112, and the lower core 114 includes the lower coil 38 contained in the lower core 114. In the solenoid valve device 110, a gel part 116 between the upper coil 36 and the armature 30 and a gel part 118 between the lower coil 38 and the armature 30 are provided in addition to the elements of the embodiment of FIG. 1.

Figure 9:
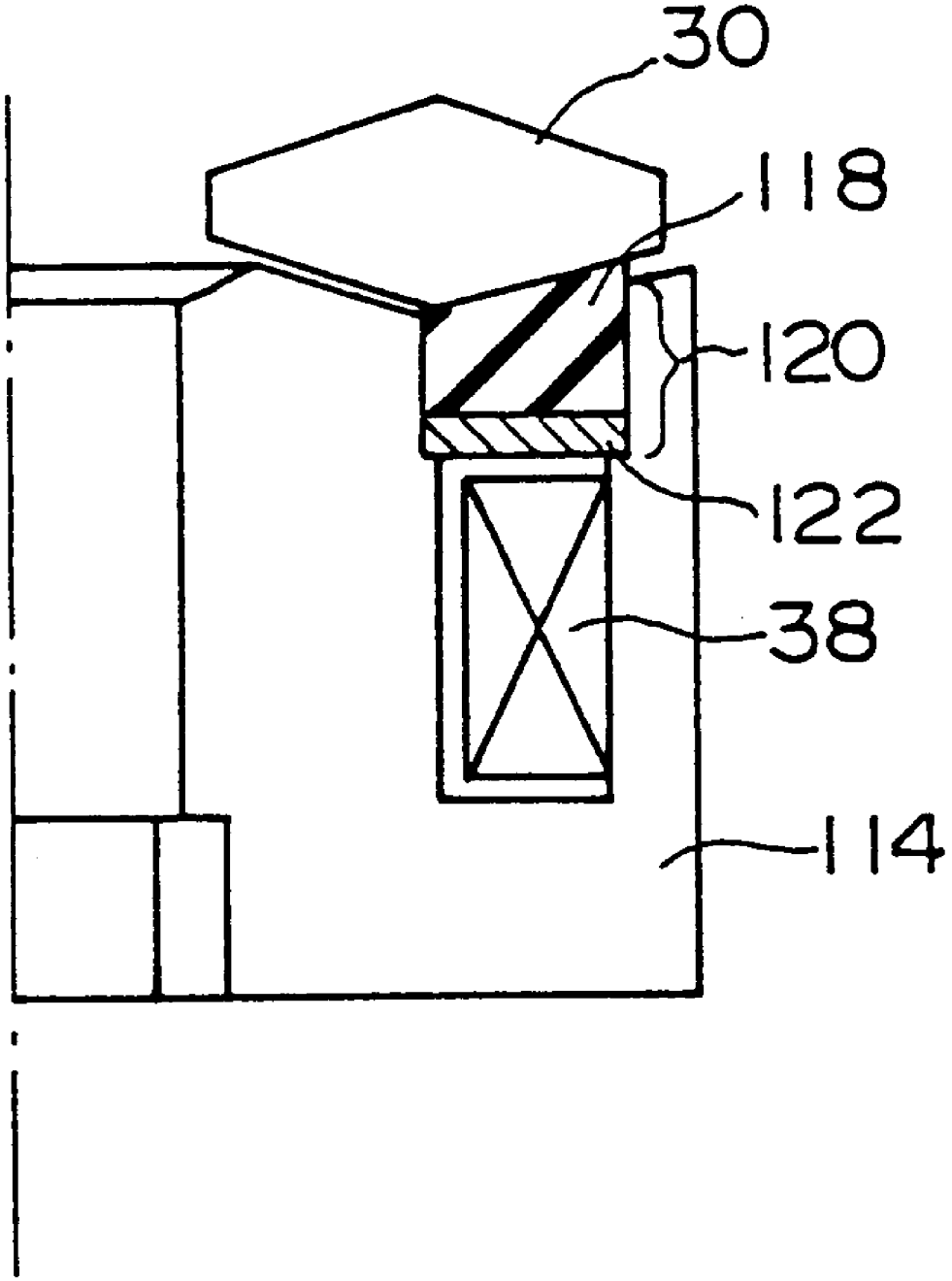
FIG. 9 is an enlarged view of an essential part of the solenoid valve device of FIG. 8.

FIG. 9 is an enlarged view of the lower coil 38 in the lower core 114 of the solenoid valve device 110 of FIG. 8. As shown in FIG. 9, the lower core 114 includes a gel mounting portion 120 provided above the lower coil 38. The gel mounting portion 120 has a width that is slightly greater than a width of the lower coil 38. In the gel mounting portion 120, the gel part 118 and a non-magnetic metal plate 122 are contained. The gel part 118 is provided on the lower core 114 such that the gel part 118 slightly projects over the top of the lower core 114. Hence, the gel part 118 effectively absorbs the impact energy when the armature 30 hits the lower core 114. The metal plate 122 is an annular member formed from a non-magnetic metal material, and the metal plate 122 is provided between the gel part 118 and the lower coil 38.

In the solenoid valve device 110 of the present embodiment, the lower coil 38 includes a bobbin (not shown) of a resin material. It is desirable to avoid subjecting the lower coil 38 to a large compressive stress when the armature 30 hits the lower core 114. The metal plate 122 is provided between the gel part 118 and the lower coil 38. Hence, according to the solenoid valve device 110 of the present embodiment, it is possible to prevent the lower coil 38 of the lower core 114 from being greatly compressed by the armature 30 when the armature 30 hits the lower core 114, and it is possible for the gel part 118 to effectively absorb the impact energy when the armature 30 hits the lower core 114.

In the solenoid valve device 110 of the present embodiment, the upper core 112 is configured in the same manner as the lower core 114 of FIG. 9. Hence, according to the solenoid valve device 110 of the present embodiment, it is possible to prevent the upper coil 36 of the upper core 112 from being greatly compressed by the armature 30 when the armature 30 hits the upper core 112, and it is possible for the gel part 116 to effectively absorb the impact energy when the armature 30 hits the upper core 112.

Similar to the embodiment of FIG. 1, in the solenoid valve device 110 of FIG. 8, when a proper exciting current is supplied to the upper coil 36, an electromagnetic force is exerted between the armature 30 and the upper core 112, and the valving element 18 can move up to the valve-closed position.

In the solenoid valve device 110 of the present embodiment, the following phenomena sequentially occur during the movement of the valving element 18 to the valve-closed position:

(1) The valving element 18 moves up together with the valve shaft 20 and the armature shaft 28.

(2) The armature 30 hits the gel part 116.

(3) The valving element 18 further moves up with the gel part 116 being deformed by the armature 30.

(4) The valving element 18 moves up to the valve-closed position. The armature shaft 28 is separated from the valve shaft 20 after the valving element 18 reaches the valve-closed position, and the armature shaft 28 and the armature 30 further move up with the gel part 116 being deformed until the armature 30 contacts the upper core 112.

According to the solenoid valve device 110, when the gel part 116 is deformed by the armature 30, the mechanical energy of the impact is effectively absorbed due to the deformation of the gel part 116. The speed of the upward movement of the valving element 18 is rapidly decreased with the absorption of the impact energy, and it is possible for the solenoid valve device 110 of the present embodiment to effectively reduce the impact sound when the valving element 18 reaches the valve-closed position and when the armature 30 hits the upper core 112.

In the solenoid valve device 110 of the present embodiment, after the armature 30 contacts the upper core 112, only the actuating force of the upper spring 72 acts to push the armature 30 in the downward direction to separate the armature 30 from the upper core 112. The gel part 116 functions to absorb the impact energy of the armature 30 on the upper core 112 when the armature 30 is in contact with the upper core 112. It is not necessary to supply a large amount of the exciting current to the upper coil 36 in order to maintain the valving element 18 at the valve-closed position against the actuating force of the impact absorbing spring as in the conventional solenoid valve device.

If an electromagnetic force that is greater than the actuating force of the upper spring 72 is exerted between the armature 30 and the upper core 112 when the armature 30 is in contact with the upper core 112, it is possible for the solenoid valve device 110 of the present embodiment to maintain the valving element 18 at the valve-closed position. In the solenoid valve device 110 of the present embodiment, the upper spring 72 which provides a relatively small actuating force can be used because of the gel part 116. Hence, the solenoid valve device 110 of the present invention is not only effective in reducing the impact sound but also effective in decreasing the power consumption.

In the solenoid valve device 110 of the present embodiment, when the exciting current supplied to the upper coil 36 is cut and the supplying of the exciting current to the lower coil 38 is started at an appropriate timing, an electromagnetic force to push the armature 30 in the downward direction of FIG. 8 is exerted between the armature and the lower core 114, and the valving element 18 can move down to the valve-open position. During the downward movement of the valving element 18 to the valve-open position, the gel part 118 functions to absorb the impact energy of the upper retainer 70 and the gel part 62 and the impact energy of the armature 30 and the lower core 114 in the same manner as the gel parts 62 and 64 in the solenoid valve device 10 of FIG. 1. Hence, when the valving element 18 moves to the valve-open position and the valving element 18 is held at the valve-open position, the solenoid valve device 110 of the present embodiment is not only effective in reducing the impact sound but also effective in decreasing the power consumption.

Accordingly, in the solenoid valve device 110 of the present embodiment, when the valving element 18 opens and closes the fluid passage, it is possible to effectively reduce the impact sound and effectively decrease the power consumption.

Figure 10:
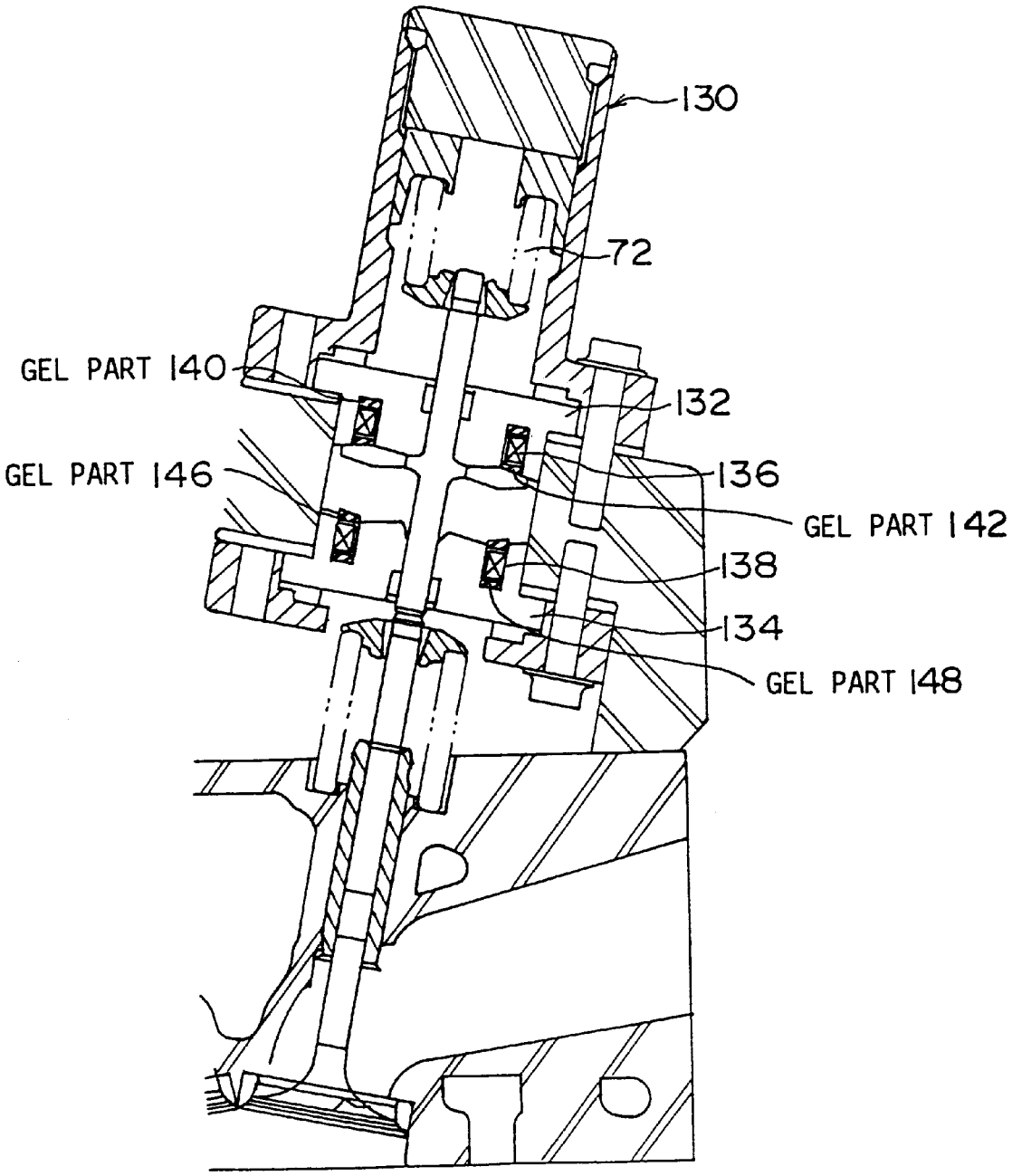
FIG. 10 is a cross-sectional view of a fifth embodiment of the solenoid valve device according to the present invention.

Next, FIG. 10 shows a fifth embodiment of the solenoid valve device which incorporates the principles of the present invention. In FIG. 10, the elements which are the same as corresponding elements in FIG. 1 are designated by the same reference numerals, and a description thereof will be omitted.

As shown in FIG. 10, a solenoid valve device 130 of the present embodiment includes an upper core 132 and a lower core 134. The upper core 132 includes an upper coil 136 contained in the upper core 132, and the lower core 134 includes a lower coil 138 contained in the lower core 134. In the solenoid valve device 130, there are provided a gel part 140 on the top of the upper coil 136, a gel part 142 on the bottom of the upper coil 136, a gel part 146 on the top of the lower coil 138, and a gel part 148 on the bottom of the lower coil 138.

Figure 11:
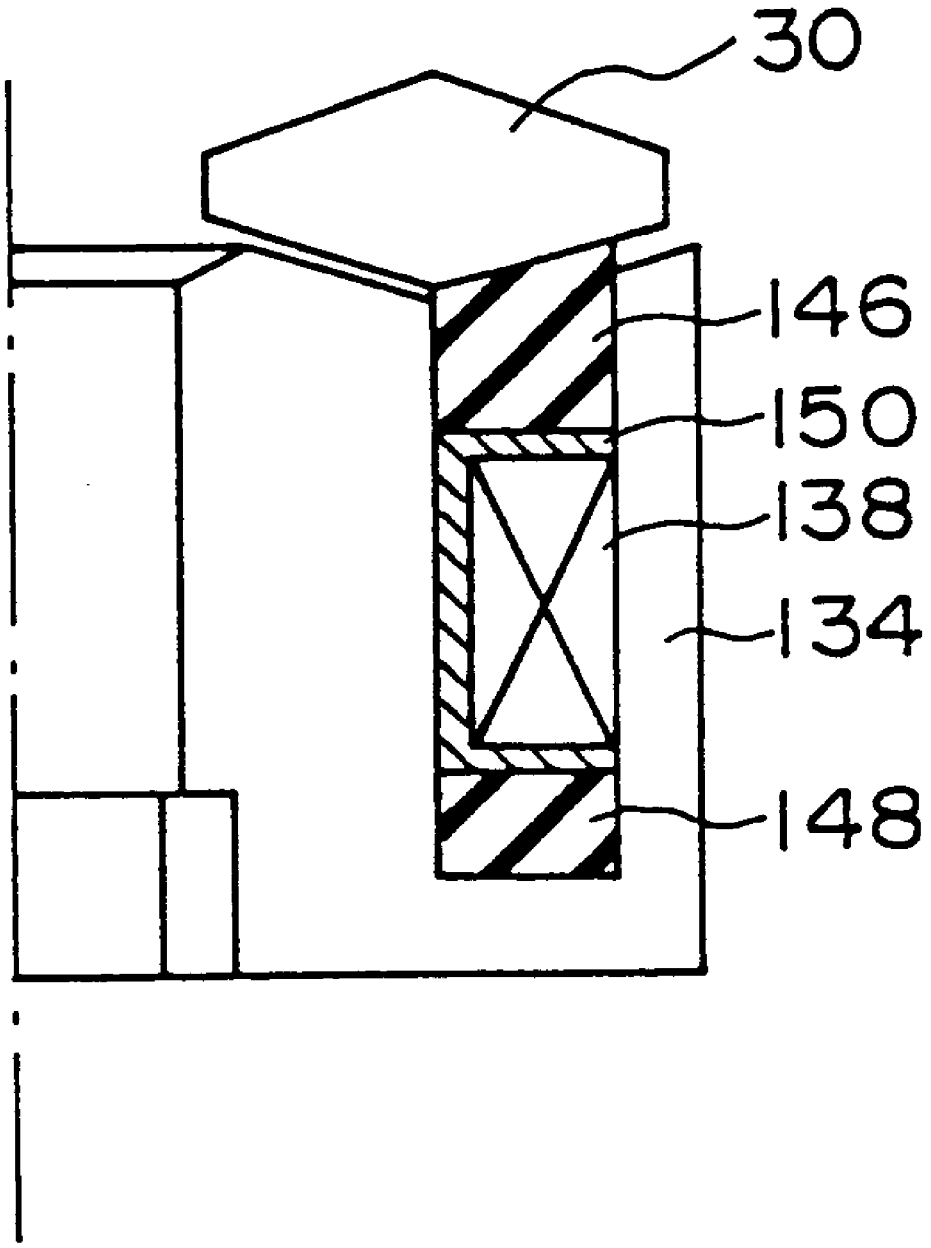
FIG. 11 is an enlarged view of an essential part of the solenoid valve device of FIG. 10.

FIG. 11 is an enlarged view of the lower coil 138 in the lower core 134 of the solenoid valve device 130 of FTG. 10. As shown in FIG. 11, the lower core 134 includes the lower coil 138, the gel part 146 and the gel part 148. The gel part 146 is provided on the top of the lower core 134 such that the gel part 146 slightly projects over the top of the lower core 134. The gel part 148 is provided on the bottom of the lower coil 138 within the lower core 134. Hence, the gel parts 146 and 148 effectively absorb the impact energy when the armature 30 hits the lower core 134.

In the solenoid valve device 130 of the present embodiment, the gel part 146, the lower coil 138 and the gel part 148 have a substantially identical width. Hence, when the armature 30 hits the lower core 134, the impact energy is transferred from the gel part 146 to the gel part 148 through the lower coil 138. Hence, the gel parts 146 and 148 effectively absorb the impact energy when the armature 30 hits the lower core 134.

In the solenoid valve device 130 of the present embodiment, the lower coil 138 includes a bobbin 150 of a non-magnetic metallic material provided around the lower coil 138. The bobbin 150 provides an adequate level of rigidity and durability for the lower coil 138 when the lower core 134 is subjected to a high compressive stress. The bobbin 150 is provided between the gel part 146 and the lower coil 138 and between the lower coil 138 and the gel part 148. Hence, according to the solenoid valve device 130 of the present embodiment, it is possible to prevent the lower coil 138 of the lower core 134 from being greatly compressed by the armature 30 when the armature 30 hits the lower core 134, and it is possible for the gel parts 146 and the 148 to effectively absorb the impact energy when the armature 30 hits the lower core 134.

In the solenoid valve device 130 of the present embodiment, the upper core 132 is configured in the same manner as the lower core 134 of FIG. 11. Hence, according to the solenoid valve device 130 of the present embodiment, it is possible to prevent the upper coil 136 of the upper core 132 from being greatly compressed by the armature 30 when the armature 30 hits the upper core 132, and it is possible for the gel parts 140 and 142 to effectively absorb the impact energy when the armature 30 hits the upper core 132.

Similar to the embodiment of FIG. 1, in the solenoid valve device 130 of FIG. 10, when a proper exciting current is supplied to the upper coil 136, an electromagnetic force is exerted between the armature 30 and the upper core 132, and the valving element 18 can move up to the valve-closed position.

In the solenoid valve device 130 of the present embodiment, the following phenomena sequentially occur during the movement of the valving element 18 to the valve-closed position:

(1) The valving element 18 moves up together with the valve shaft 20 and the armature shaft 28.
(2) The armature 30 hits the gel part 142.
(3) The valving element 18 further moves up with the gel parts 140 and 142 being deformed by the armature 30.
(4) The valving element 18 moves up to the valve-closed position. The armature shaft 28 is separated from the valve shaft 20 after the valving element 18 reaches the valve-closed position, and the armature shaft 28 and the armature 30 further move up with the gel parts 140 and 142 being deformed until the armature 30 contacts the upper core 132.

According to the solenoid valve device 130, when the gel parts 140 and 142 are deformed by the armature 30, the mechanical energy of the impact is effectively absorbed due to the deformation of the gel parts 140 and 142. The speed of the upward movement of the valving element 18 is rapidly decreased with the absorption of the impact energy, and it is possible for the solenoid valve device 130 of the present embodiment to effectively reduce the impact sound when the valving element 18 reaches the valve-closed position and when the armature 30 hits the upper core 132.

In the solenoid valve device 130 of the present embodiment, after the armature 30 contacts the upper core 132, only the actuating force of the upper spring 72 acts to push the armature 30 in the downward direction to separate the armature 30 from the upper core 132. The gel parts 140 and 142 function to absorb the impact energy of the armature 30 on the upper core 132 when the armature 30 is in contact with the upper core 132. It is not necessary to supply a large amount of the exciting current to the upper coil 136 in order to maintain the valving element 18 at the valve-closed position against the actuating force of the impact absorbing spring as in the conventional solenoid valve device.

If an electromagnetic force that is greater than the actuating force of the upper spring 72 is exerted between the armature 30 and the upper core 132 when the armature 30 is in contact with the upper core 132, it is possible for the solenoid valve device 130 of the present embodiment to stably maintain the valving element 18 at the valve-closed position. In the solenoid valve device 130 of the present embodiment, the upper spring 72 which provides a relatively small actuating force can be used because of the gel parts 140 and 142. Hence, the solenoid valve device 130 of the present invention is not only effective in reducing the impact sound but also effective in decreasing the power consumption.

In the solenoid valve device 130 of the present embodiment, when the exciting current supplied to the upper coil 136 is cut and the supplying of the exciting current to the lower coil 138 is started at an appropriate timing, an electromagnetic force to push the armature 30 in the downward direction of FIG. 10 is exerted between the armature and the lower core 134, and the valving element 18 can move down to the valve-open position. During the downward movement of the valving element 18 to the valve-open position, the gel parts 146 and 148 function to absorb the impact energy of the armature 30 and the lower core 134 in the same manner as the gel parts 140 and 142. Hence, when the valving element 18 moves to the valve-open position and the valving element 18 is held at the valve-open position, the solenoid valve device 130 of the present embodiment is not only effective in reducing the impact sound but also effective in decreasing the power consumption.

Accordingly, in the solenoid valve device 130 of the present embodiment, when the valving element 18 opens and closes the fluid passage, it is possible to effectively reduce the impact sound and effectively decrease the power consumption.

Figure 12:
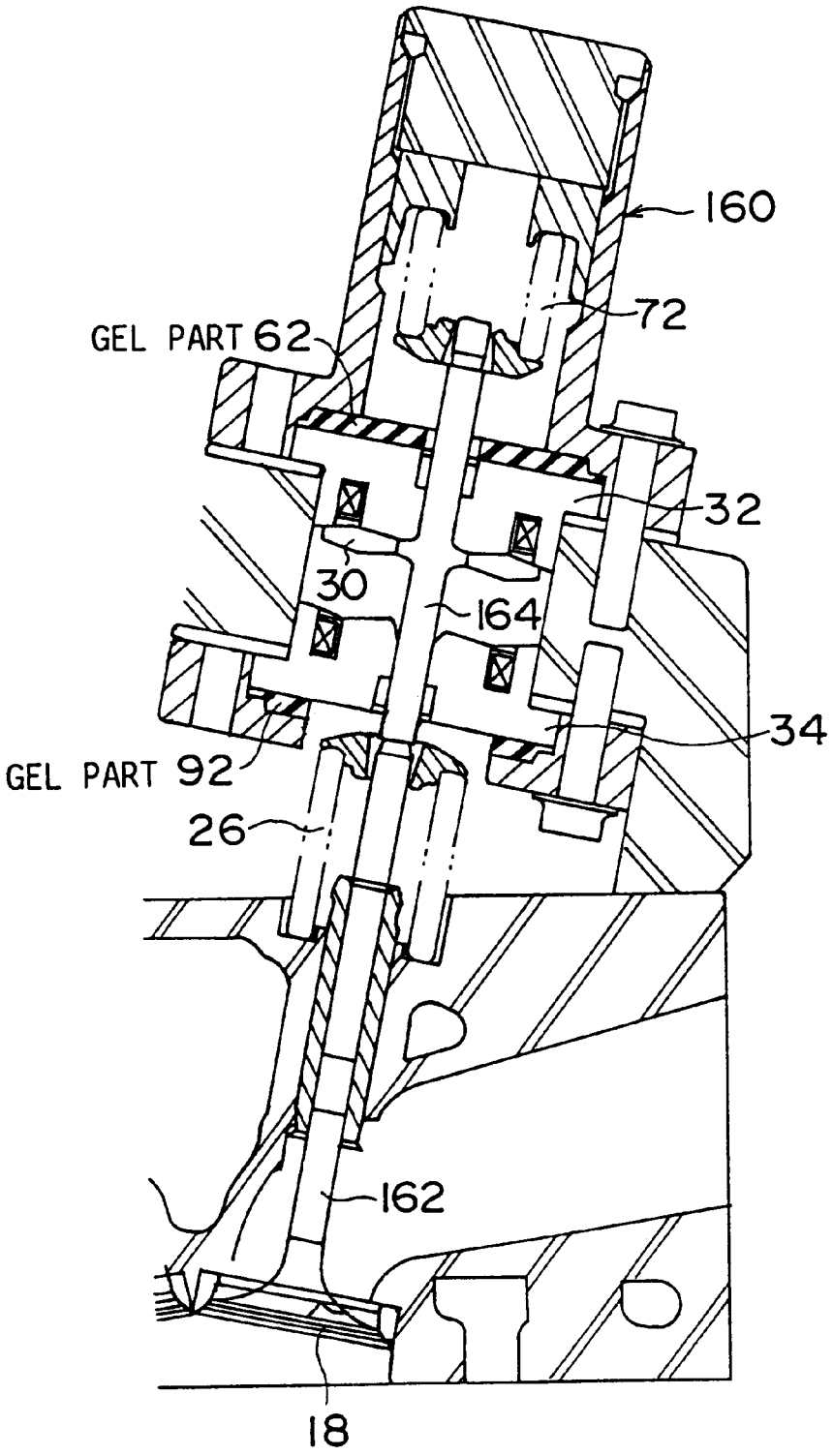
FIG. 12 is a cross-sectional view of a sixth embodiment of the solenoid valve device according to the present invention.

Next, FIG. 12 shows a sixth embodiment of the solenoid valve device which incorporates the principles of the present invention. In FIG. 12, the elements which are the same as corresponding elements in FIG. 6 are designated by the same reference numerals, and a description thereof will be omitted.

As shown in FIG. 12, a solenoid valve device 160 of the present embodiment includes a valve shaft 162 and an armature shaft 164 which are formed integrally with each other. The valve shaft 162, the armature shaft 164 and the upper core 32 are configured such that a given clearance between the armature 30 and the upper core 32 is produced when the valving element 18 moves up to the valve-closed position. Hence, in the present embodiment, the armature 30 does not contact the upper core 32 when the valving element 18 opens and closes the fluid passage.

In the solenoid valve device 160 of the present embodiment, the armature 30 does not hit the upper core 32 when the valving element 18 moves up to the valve-closed position, and thus a loud impact sound is not produced. The solenoid valve device 160 includes no element provided to reduce the speed of the upward movement of the armature 30 before the valving element 18 reaches the valve-closed position. However, it is possible for the solenoid valve device 160 of the present embodiment to reduce the impact sound when the valving element 18 moves up to the valve-closed position.

In the solenoid valve device 160 of the present embodiment, after the valving element 18 reaches the valve-closed position, only the actuating force of the upper spring 72 acts to push the armature 30 in the downward direction of FIG. 12. It is not necessary to supply a large amount of the exciting current to the upper coil 36 in order to maintain the valving element 18 at the valve-closed position against the actuating force of the impact absorbing spring as in the conventional solenoid valve device. In this condition, if an electromagnetic force that is greater than the actuating force of the upper spring 72 is exerted between the armature 30 and the upper core 32, it is possible for the solenoid valve device 160 of the present embodiment to stably maintain the valving element 18 at the valve-closed position. Hence, the solenoid valve device 160 of the present invention is not only effective in reducing the impact sound but also effective in decreasing the power consumption.

In the solenoid valve device 160 of the present embodiment, the gel part 62 and the gel part 92 function to absorb the impact energy of the armature 30 and the lower core 34 in the same manner as corresponding elements in the embodiments of FIG. 6 and FIG. 7 during the upward movement of the valving element 18 to the valve-closed position and during the downward movement of the valving element 18 to the valve-open position. Hence, when the valving element 18 moves to the valve-open position and the valving element 18 is held at the valve-open position, the solenoid valve device 160 of the present embodiment is not only effective in reducing the impact sound but also effective in decreasing the power consumption.

Figure 13:
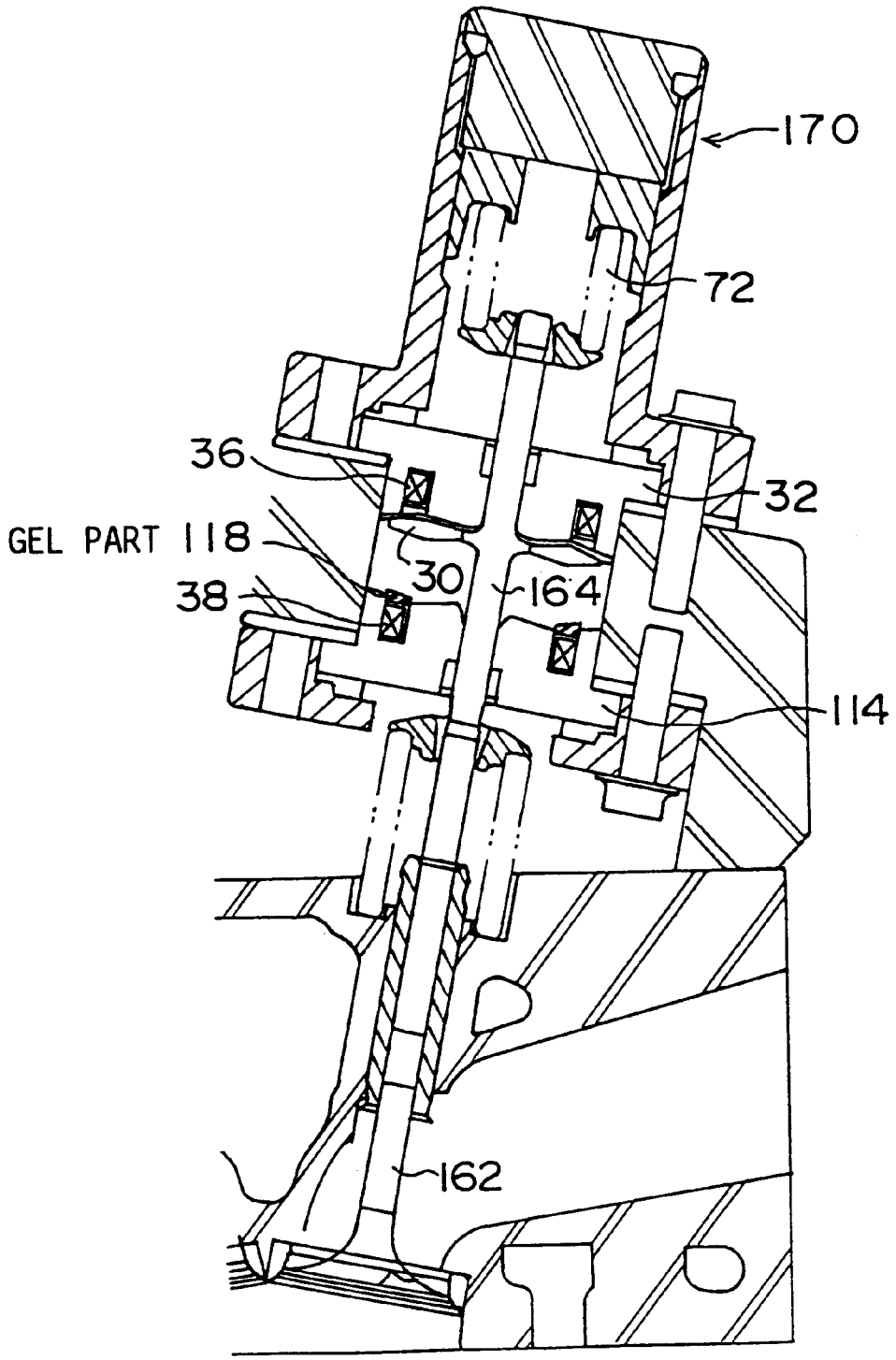
FIG. 13 is a cross-sectional view of a seventh embodiment of the solenoid valve device according to the present invention.

Next, FIG. 13 shows a seventh embodiment of the solenoid valve device which incorporates the principles of the present invention. In FIG. 13, the elements which are the same as corresponding elements in FIG. 8 or FIG. 12 are designated by the same reference numerals, and a description thereof will be omitted.

As shown in FIG. 13, a solenoid valve device 170 of the present embodiment includes the valve shaft 162 and the armature shaft 164 which are the same as corresponding elements in the embodiment of FIG. 12. The valve shaft 162 and the armature shaft 164 are formed integrally with each other. The valve shaft 162, the armature shaft 164 and the upper core 32 are configured such that a given clearance between the armature 30 and the upper core 32 is produced when the valving element 18 moves up to the valve-closed position. Hence, in the present embodiment, the armature 30 does not contact the upper core 32 when the valving element 18 opens and closes the fluid passage.

In the solenoid valve device 170 of the present embodiment, the armature 30 does not hit the upper core 32 when the valving element 18 moves up to the valve-closed position, and thus does not produce a loud impact sound. Hence, it is possible for the solenoid valve device 170 of the present embodiment to reduce the impact sound when the valving element 18 moves up to the valve-closed position.

In the solenoid valve device 170 of the present embodiment, after the valving element 18 reaches the valve-closed position, only the actuating force of the upper spring 72 acts to push the armature 30 in the downward direction of FIG. 13. It is not necessary to supply a large amount of the exciting current to the upper coil 36 in order to maintain the valving element 18 at the valve-closed position against the actuating force of the impact absorbing spring as in the conventional solenoid valve device. In this condition, if an electromagnetic force that is greater than the actuating force of the upper spring 72 is exerted between the armature 30 and the upper core 132, it is possible for the solenoid valve device 170 of the present embodiment to stably maintain the valving element 18 at the valve-closed position. Hence, the solenoid valve device 170 of the present invention is not only effective in reducing the impact sound but also effective in decreasing the power consumption.

In the solenoid valve device 170 of the present embodiment, the gel part 118 between the lower coil 38 and the armature 30 is provided on the lower core 114. The gel part 118 in the present embodiment functions to absorb the impact energy of the armature 30 and the lower core 114 in the same manner as corresponding elements in the embodiment of FIG. 8 during the upward movement of the valving element 18 to the valve-closed position and during the downward movement of the valving element 18 to the valve-open position. Hence, when the valving element 18 moves to the valve-open position and the valving element 18 is held at the valve-open position, the solenoid valve device 170 of the present embodiment is not only effective in reducing the impact sound but also effective in decreasing the power consumption.

Figure 14:
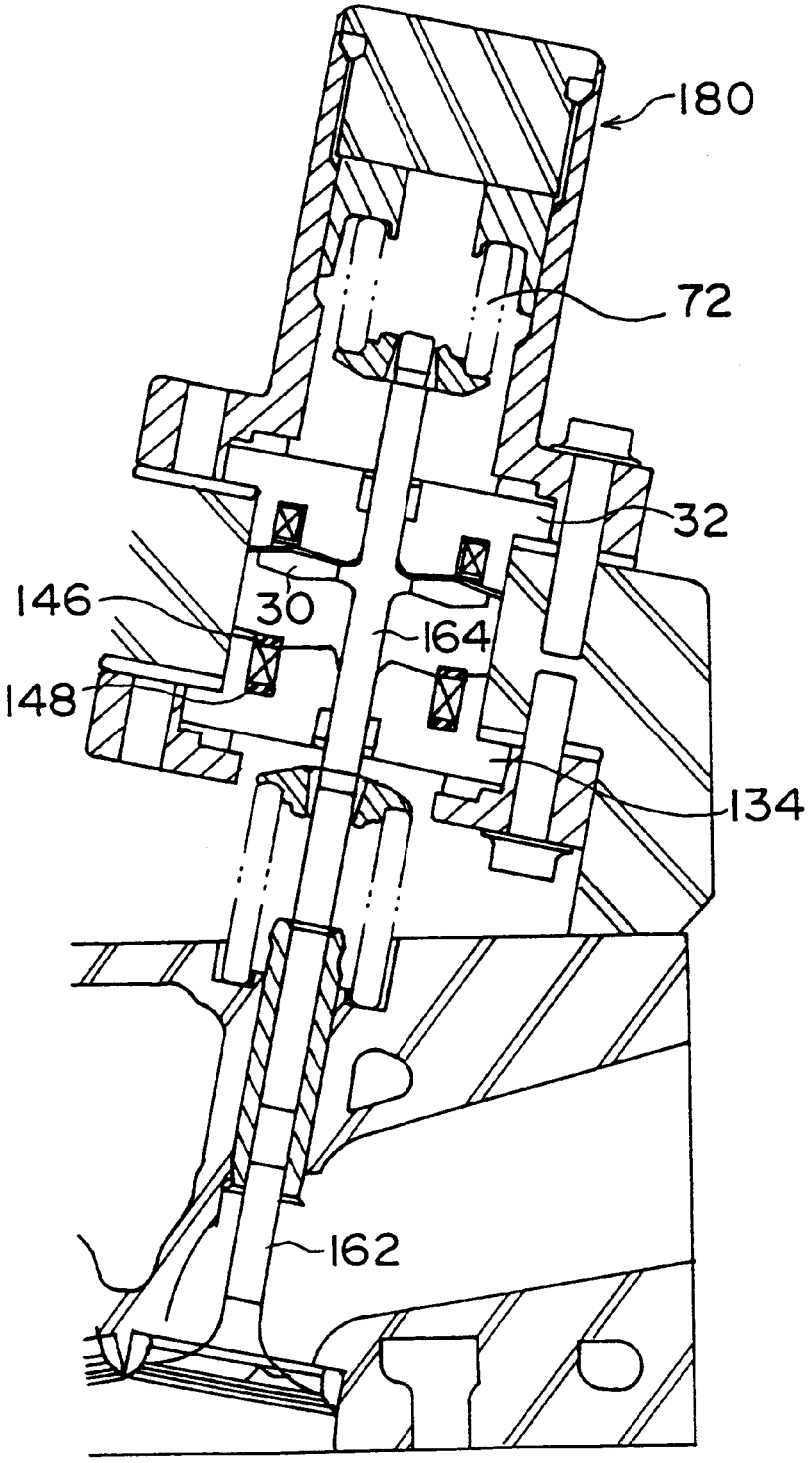
FIG. 14 is a cross-sectional view of an eighth embodiment of the solenoid valve device according to the present invention.

Next, FIG. 14 shows an eighth embodiment of the solenoid valve device which incorporates the principles of the present invention. In FIG. 14, the elements which are the same as corresponding elements in FIG. 10 or FIG. 12 are designated by the same reference numerals, and a description thereof will be omitted.

As shown in FIG. 14, a solenoid valve device 180 of the present embodiment includes the valve shaft 162 and the armature shaft 164 which are the same as corresponding elements in the embodiments of FIG. 12 and FIG. 13. The valve shaft 162 and the armature shaft 164 are formed integrally with each other. The valve shaft 162, the armature shaft 164 and the upper core 32 are configured such that a given clearance between the armature 30 and the upper core 32 is produced when the valving element 18 moves up to the valve-closed position. Hence, in the present embodiment, the armature 30 does not contact the upper core 32 when the valving element 18 opens and closes the fluid passage.

In the solenoid valve device 180 of the present embodiment, the armature 30 does not hit the upper core 32 when the valving element 18 moves up to the valve-closed position, and thus does not produce a loud impact sound. Hence, it is possible for the solenoid valve device 180 of the present embodiment to reduce the impact sound when the valving element 18 moves up to the valve-closed position.

In the solenoid valve device 180 of the present embodiment, after the valving element 18 reaches the valve-closed position, only the actuating force of the upper spring 72 acts to push the armature 30 in the downward direction of FIG. 14. It is not necessary to supply a large amount of the exciting current to the upper coil 36 in order to maintain the valving element 18 at the valve-closed position against the actuating force of the impact absorbing spring as in the conventional solenoid valve device. In this condition, if an electromagnetic force that is greater than the actuating force of the upper spring 72 is exerted between the armature 30 and the upper core 32, it is possible for the solenoid valve device 180 of the present embodiment to stably maintain the valving element 18 at the valve-closed position. Hence, the solenoid valve device 180 of the present invention is not only effective in reducing the impact sound but also effective in decreasing the power consumption.

In the solenoid valve device 180 of the present embodiment, the gel part 146 on the top of the lower coil 138 and the gel part 148 on the bottom of the lower coil 138 are provided in the lower core 134. The gel parts 146 and 148 in the present embodiment function to absorb the impact energy of the armature 30 and the lower core 134 in the same manner as corresponding elements in the embodiment of FIG. 10 during the upward movement of the valving element 18 to the valve-closed position and during the downward movement of the valving element 18 to the valve-open position. Hence, when the valving element 18 moves to the valve-open position and the valving element 18 is held at the valve-open position, the solenoid valve device 180 of the present embodiment is not only effective in reducing the impact sound but also effective in decreasing the power consumption.

Next, a description will be given of a ninth embodiment of the solenoid valve device which incorporates the principles of the present invention.

In the solenoid valve device of the present embodiment, an impact absorbing unit including silicone foam parts is provided, and the silicone foam parts are arranged in place of the gel parts in the embodiments of FIGS. 1, 6–8, 10 and 12–14.

In the solenoid valve device of the present embodiment, the silicone foam parts are prepared by mixing a normal-temperature curing silicone with a foaming agent and causing the mixture and fine bubbles of air therein to form a silicone foam. The resulting silicone foam is formed in a shape similar to the shape of the gel part shown in FIG. 2 or FIG. 5.

Similar to the embodiment of FIG. 1, in the solenoid valve device of the present embodiment, the movable portion including the armature 30 and the valving element 18, and the fixed portion including the upper core 32 and the lower core 34 are provided, and the valving element 18 opens and closes the fluid passage between the port 14 and the combustion chamber 16 by exerting either an electromagnetic force between the armature 30 and the upper core 32 or an electromagnetic force between the armature 30 and the lower core 34. In the solenoid valve device of the present embodiment, when the valving element 18 moves up to the valve-closed position and when the valving element 18 moves down to the valve-open position, the impact absorbing unit, including the silicone foam parts, effectively absorbs the impact of the movable portion and the fixed portion.

Similar to the first through eighth embodiments, it is possible for the solenoid valve device of the present embodiment to effectively reduce the impact sound when the valving element 18 moves up to the valve-closed position and when the valving element 18 moves down to the valve-open position.

As described above, the silicone foam parts of the impact absorbing unit in the present embodiment include the silicone foam and the bubbles of air contained therein. In the case of the gel parts 62 and 64 as in the embodiment of FIG. 1, they are prepared from a nonfoam resin material and are formed in a gel state. When the gel parts 62 and 64 are subjected to compression impact between the armature and the core, the gel parts 62 and 64 are deformed and transform part of a mechanical energy of the impact into a thermal energy. In the gel parts 62 and 64, the thermal energy is dispersed and the remaining impact energy is absorbed due to the deformation of the nonfoam resin material. In contrast, when the silicone foam parts are subjected to compression impact, the silicone foam of the silicone foam parts is deformed, and at the same time the bubbles of air in the silicone foam are compressed. In the silicone foam parts, the impact energy is absorbed due to the deformation of the silicone foam and the compression of the air in the silicone foam.

In the silicone foam parts of the present embodiment, the reaction caused by the compression of the air is smaller than the reaction caused by the deformation of the silicone foam. The silicone foam parts of the present embodiment ensure an adequate amount of the deformation and a controlled level of the reaction when subjected to compression impact. Hence, in the solenoid valve device of the present embodiment, the silicone foam parts effectively absorb the impact energy of the armature and the core and provide a controlled level of the reaction. Similar to the embodiments of FIGS. 1, 6–8, 10 and 12–14, it is possible for the solenoid valve device of the present embodiment to effectively reduce the impact sound and effectively decrease the power consumption.

In the solenoid valve device of the present embodiment, when the valving element 18 moves up to the valve-closed position or when the valving element 18 moves down to the valve-open position, the silicone foam in the silicone foam parts is deformed and the bubbles of air in the silicone foam parts are compressed. When the valving element 18 restarts the movement and the compressive stress is removed after the valving element 18 reaches the valve-closed position or the valve-open position, the silicone foam parts can quickly recover the original shape from the compressed shape.

In order for the solenoid valve device of the present embodiment to suitably carry out the impact absorbing performance, it is necessary for the impact absorbing unit to quickly recover the original shape before the valving element 18 reaches the valve-closed position or the valve-open position. As described above, when the valving element 18 restarts the movement and the compressive stress is removed after the valving element 18 reaches the valve-closed position or the valve-open position, the silicone foam parts can quickly recover the original shape from the compressed shape. Hence, even when the engine is operating at a high speed, the solenoid valve device of the present embodiment is effective in decreasing the power consumption as well as effective in reducing the impact sound.

The impact absorbing unit of the present embodiment may be prepared from one of silicone foam materials HT-800, HT-820, HT-870 and BF-1000 supplied by Rogers Corporation. The silicone foam materials have a high temperature resistance and meet temperature requirements related to temperature vs. compressibility and so on. The silicone foam materials are not influenced by environmental temperature changes and provide a stable performance over an extended period of time. Hence, the solenoid valve device of the present embodiment having such impact absorbing units can effectively reduce the impact sound and effectively decrease the power consumption without being influenced by the operating conditions of the engine.

Further, the present invention is not limited to the above-described embodiments, and variations and modifications may be made without departing from the scope of the present invention. For example, in the above-described ninth embodiment, the impact absorbing unit of the silicone foam material is provided. However, the present invention is not limited to this embodiment. An impact absorbing unit of another foam material may be provided in the solenoid valve device of the present invention.

The present invention is based on Japanese priority application No.9-215012, filed on Aug. 8, 1997, and Japanese priority application No.9-335970, filed on Dec. 5, 1997, the entire contents of which are hereby incorporated by reference.

What is claimed is:

1. A solenoid valve device in which a valving element opens and closes a fluid passage by exerting an electromagnetic force between an armature and a core, the solenoid valve device comprising:

a movable portion including the armature and the valving element;

a fixed portion including the core; and an impact absorbing unit for absorbing an impact of the movable portion on the fixed portion, the impact absorbing unit including a gel part transforming a mechanical energy of the impact into a thermal energy.

2. The solenoid valve device according to claim 1, wherein the gel part is provided between the armature and the core.

3. The solenoid valve device according to claim 1, wherein the movable portion includes an actuating spring for exerting an actuating force on the movable portion to hold the movable portion at a neutral position, and a retainer for holding the actuating spring in the retainer, and wherein the gel part is provided between the retainer and the core.

4. The solenoid valve device according to claim 1, wherein the movable portion and the fixed portion are configured such that a given clearance between the armature and the core is produced when the valving element moves up to a valve-closed position, and wherein the gel part is provided at a position where the movable portion hits the fixed portion when the valving element moves to a valve-open position.

5. The solenoid valve device according to claim 1, wherein the movable portion includes an armature shaft, and the gel part is provided above the armature shaft such that the armature shaft contacts the gel part before the valving element reaches a valve-closed position during an upward movement of the valving element.

6. The solenoid valve device according to claim 1, wherein the fixed portion includes a coil contained in the core, and the impact absorbing unit includes a first gel part provided between the armature and the core and a second gel part provided on a bottom of the coil within the core.

7. A solenoid valve device in which a valving element opens and closes a fluid passage by exerting an electromagnetic force between an armature and a core, the solenoid valve device comprising:

a movable portion including the armature and the valving element;

a fixed portion including the core and a case, wherein the core is movably held by the case such that the core is movable in an axial direction of the solenoid valve device; and an impact absorbing unit for absorbing an impact of the movable portion on the fixed portion, the impact absorbing unit including a gel part provided between the core and the case, the gel part transforming a mechanical energy of the impact into a thermal energy.

8. The solenoid valve device according to claim 7, wherein the movable portion includes an armature shaft, and the gel part is provided above the armature shaft such that the armature shaft contacts the gel part before the valving element reaches a valve-closed position during an upward movement of the valving element.

9. A solenoid valve device in which a valving element opens and closes a fluid passage by exerting an electromagnetic force between an armature and a core, the solenoid valve device comprising:

a movable portion including the armature and the valving element;

a fixed portion including the core; and an impact absorbing unit provided at a position where the movable portion hits the fixed portion, the impact absorbing unit absorbing an impact of the movable portion on the fixed portion, the impact absorbing unit including a foam part, the foam part being deformed and compressed when absorbing the impact.

10. The solenoid valve device according to claim 9, wherein the foam part is made of a silicone foam material.

* * * * *

UNITED STATES PATENT AND TRADEMARK OFFICE

CERTIFICATE OF CORRECTION

PATENT NO. : 6,032,925
DATED : March 7, 2000
INVENTOR(S) : Takashi Izuo, et al.

It is certified that error appears in the above-identified patent and that said Letters Patent is hereby corrected as shown below:

Title page,
Item [54], Title should read as follows:
-- [54] Title: SOLENOID VALVE DEVICE --

Signed and Sealed this

Twenty-third Day of October, 2001

*Attest:*

Nicholas P. Godici

NICHOLAS P. GODICI
*Acting Director of the United States Patent and Trademark Office*

*Attesting Officer*